US006007954A

United States Patent [19]

Visser et al.

[11] Patent Number: 6,007,954

[45] **Date of Patent: *Dec. 28, 1999**

[54] ELECTROPHOTOGRAPHIC APPARATUS WITH IMPROVED BLUE SENSITIVITY

[75] Inventors: Susan A. Visser, Rochester; Donald S. Rimai, Webster; Paul M. Borsenberger, Hilton; Suryadevara V. Babu, Potsdam, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/023,901

[22] Filed: Feb. 13, 1998

[51] Int. Cl.[6] ..... G03G 13/22

[52] U.S. Cl. ..... 430/31

[58] Field of Search ..... 430/31

[56] References Cited

U.S. PATENT DOCUMENTS

| | | | |
|---|---|---|---|
| 3,615,414 | 10/1971 | Light | 430/74 |
| 4,082,551 | 4/1978 | Steklenski et al. | 428/420 |
| 4,175,960 | 11/1979 | Berwick et al. | 430/58 |
| 4,602,863 | 7/1986 | Fritz et al. | 430/106.6 |
| 4,886,722 | 12/1989 | Law et al. | 430/59 |
| 4,895,782 | 1/1990 | Koyama et al. | 430/58 |
| 4,965,156 | 10/1990 | Hotomi et al. | 430/128 |
| 5,202,207 | 4/1993 | Kanemaru et al. | 430/59 |
| 5,213,927 | 5/1993 | Kan et al. | 430/59 |
| 5,324,605 | 6/1994 | Ono et al. | 430/59 |
| 5,330,865 | 7/1994 | Leus et al. | 430/59 |
| 5,332,635 | 7/1994 | Tanaka | 430/96 |
| 5,525,447 | 6/1996 | Ikuno et al. | 430/67 |
| 5,614,342 | 3/1997 | Molaire et al. | 430/78 |

OTHER PUBLICATIONS

W. Sorenson and T. Campbell, *Preparative Methods of Polymer Chemistry*, p. 137, Interscience (1968).

*Primary Examiner*—Roland Martin
*Attorney, Agent, or Firm*—Doreen M. Wells

[57] ABSTRACT

An electrophotographic apparatus with improved blue sensitivity comprises: a) a charging means; b) an exposure means, which includes light of a wavelength between 350 and 500 nanometers, and c) a photoconductive element comprising an electrically conductive base, two or more charge generation layers, at least one charge transport layer, and a protective layer comprising plasma-polymerized fluorocarbon, wherein the fluorine content of the protective layer is equal to or greater than 2.2 and less than 65 atomic percent. A method of making an image is also disclosed.

20 Claims, No Drawings

ELECTROPHOTOGRAPHIC APPARATUS WITH IMPROVED BLUE SENSITIVITY

CROSS REFERENCE TO RELATED APPLICATIONS

This application is related to the following commonly owned U.S. applications filed on even date herewith:

U.S. Ser. No. 09/023,596 of Visser, Rimai, Borsenberger & Babu titled MULTILAYER PHOTOCONDUCTIVE ELEMENTS HAVING LOW DARK DECAY, now U.S. Pat. No. 5,849,445.

U.S. Ser. No. 09/023,631 of Visser, Rimai, Borsenberger & Babu titled METHOD OF MAKING MULTILAYER ELECTROPHOTOGRAPHIC ELEMENTS now U.S. Pat. No. 5,849,443.

U.S. Ser. No. 09/023,896 pending of Visser, Rimai, Gady, Borsenberger & Babu titled CONTROL OF TRIBOCHARGING OF THE PHOTOCONDUCTOR.

FIELD OF THE INVENTION

The invention relates to electrophotographic apparatuses. More particularly, it relates to electrophotographic apparatuses having improved sensitivity to exposure in the blue region of the spectrum, wherein the apparatus comprises an electrophotographic engine and a photoconductive element have two or more charge generation layers, at least one charge transport layer, and a protective layer.

BACKGROUND OF THE INVENTION

Electrophotographic imaging processes and techniques have been extensively described in both the patent and other literature. Generally, these processes have in common the steps of employing a photoconductive insulating element which is prepared to respond to imagewise exposure with electromagnetic radiation by forming a latent electrostatic charge image. A variety of subsequent operations, now well-known in the art, can then be employed to produce a visible record of the electrostatic image.

The electromagnetic radiation used to produce the electrostatic latent image on the photoconductive element can come from a variety of sources. For example, optical exposure or electronic exposure using a laser scanner or light-emitting diode array can be used. In certain cases, it is desirable to use illumination of specific wavelength ranges for producing the electrostatic latent image. For example, reproduction of color images may require the use of an illumination source or exposure means that employs filters that limit the wavelengths of illumination reaching the photoconductive element in order to allow separation of the colors of the image. In certain cases, it is desirable that some or all of the illumination be in the wavelength range of 350 to 500 nanometers (nm), the blue region of the spectrum. Exposure by light with these wavelengths may occur when a filter is used to give blue light passage for a color separation process in producing color images or when a blue laser is used as the illumination source, for example. It is desirable to have an electrophotographic apparatus that uses exposures in the blue region of the spectrum.

Photoconductive elements useful in electrophotographic apparatuses must be sensitive to the wavelengths of illumination reaching them. In particular, a photoconductive element must display good photosensitivity. Photosensitivity is a measure of the amount of energy that must be supplied during exposure to discharge the element in an image-wise fashion. For high process efficiency, high photosensitivity and low energy requirements for discharge are desired.

An important group of photoconductive elements used in electrophotographic imaging processes comprise a conductive support in electrical contact with a charge generation layer (CGL) and a charge transport layer (CTL). A CGL is designed primarily for the photogeneration of charge carriers (holes and electrons). A CTL is designed primarily for transportation of the generated charge carriers. The combination of all CGLs and CTLs in a photoconductive element is sometimes referred to as the photoconductive layers. Electrophotographic elements having one CGL and one CTL are sometimes referred to as dual layer photoconductive elements. Representative patents disclosing methods and materials for making and using such elements include U.S. Pat. No. 5,614,342 to Molaire et al.; U.S. Pat. No. 4,175,960 to Berwick et al. and U.S. Pat. No. 4,082,551 to Steklenski et al.

Photoconductive elements containing two or more CGLs and at least one CTL, referred to herein as multilayer photoconductive elements, are known. Photoconductive elements containing a CTL and two CGLs were disclosed in U.S. Pat. No. 5,213,927 by Kan et al. This patent shows that the inclusion of two CGLs, the first containing a charge-generation material and a first charge-transport material, and the second containing a second charge transport material that is less susceptible to positive-surface charge injection than is the first charge-transport material, gives a photoconductive element with improved charge uniformity and charge acceptance upon cycling.

Multilayer photoconductive elements frequently have protective overcoats on their outermost surface to protect from damage incurred during the electrophotographic process or during installation of the element in the apparatus. The overcoat imparts longer process lifetimes to the elements. Typical overcoat materials include diamond-like carbon (DLC) or amorphous carbon films. U.S. Pat. No. 4,965,156 to Hotomi et al. discloses the use of two protective layers on an organic photoconductive element. The first layer is an amorphous carbon layer which includes more than 5 atomic percent fluorine. The second, outermost layer is a similar material except that the fluorine content must be lower than 5 atomic percent. U.S. Pat. No. 5,525,447 to Ikuno et al. discloses an electrophotographic photoconductive element with a surface protective layer formed on the photoconductive layer. The surface protective layer is a multi-layer or graduated layer structure having at least one additive element selected from the group consisting of nitrogen, fluorine, boron, phosphorous, chlorine, bromine, and iodine. The additive element is at a higher concentration near the surface of the protective layer than at the interface between the protective layer and the photoconductive layer. When the additive element is fluorine, the fluorine to carbon atomic ratio (F/C) of 0.001 or less (less than 1% fluorine) in the vicinity of the photoconductive layer adjacent to the protective layer and of 0.005 or more in the vicinity of the top surface of the protective layer.

A problem associated with protective overcoats is the undesirable absorption of radiation at particular wavelengths. DLC protective overcoats known in the art have measurable absorption in the blue range (350 to 500 nm) of the spectrum. For optical copiers in particular, this is undesirable. A decrease in blue sensitivity of the photoconductive element, resulting from absorption by the protective overcoat, is known as "blue blindness." It results in loss of blue parts of a multi-color original image. Other colors, such as red, however, are reproduced as dark lines. The result is either unacceptable loss or change of information in a black and white copy, where blue information is reproduced as gray or is not reproduced at all, or an unacceptable change in the color balance of a color copy. This can also be detrimental in digital copier and printer applications where the protective overcoat can attenuate the exposure radiation. Both the inventions of Hotomi et al. (U.S. Pat. No. 4,965,156) and of Ikuno et al. (U.S. Pat. No. 5,525,447) require that the protective overcoat contain a layer or portion of the protective overcoat that imparts significant blue blindness to the photoconductive element.

Protective layers can also change the photosensitivity and residual voltage of the photoconductive element. This can result in loss of contrast between light and dark areas in the final image and in failure to reproduce some or all of an image. The impact of the protective layer on these properties depends on the combination of its properties, for example its light absorption at particular wavelengths or its resistivity, with the properties of the other layers, particularly the photoconductive layers, in the element. Thus, it is not obvious that a protective layer that has proven useful with one type of photoconductive element will work for all photoconductive elements.

It is not evident from the prior art how to construct an electrophotographic apparatus which uses blue light exposure with a photoconductive element having a protective overcoat.

SUMMARY OF THE INVENTION

It is the object of the present invention to provide an electrophotographic apparatus with high sensitivity to exposure in the blue region of the spectrum. The electrophotographic apparatus comprises:

a) a charging means;

b) an exposure means, said exposure means including light of a wavelength between 350 and 500 nanometers (nm), c) a photoconductive element comprising an electrically conductive base, two or more charge generation layers, at least one charge transport layer, and a protective layer comprising plasma-polymerized fluorocarbon, wherein the fluorine content of said protective layer is equal to or greater than 2.2 and less than about 65 atomic percent, preferably between 10 and 65 atomic percent, more preferably between 25 and 50 atomic percent, and wherein the thickness of said protective layer is preferably between 0.05 and 0.5 $\mu$m, more preferably 0.15 to 0.35 $\mu$m.

The electrophotographic apparatus preferably additionally comprises d) a development station including electrophotographic developer, the developer preferably comprising marking or toner particles and magnetic transport or carrier particles, where the carrier particles preferably comprise hard magnetic particles, such as ferrite particles, and electrically insulative toner particles in contacting developing relation with the electrostatic charger pattern in the development zone. It is preferred that the development station comprise an external shell, containing therein an internal core, the core comprised of between 8 and 24 magnets arranged in opposite polarity, with at least the core or the shell rotating so as to transport developer into the nip formed by the shell and the photoconductive element. It is more preferable that the magnetic core rotate between 300 and 3000 rpm and be comprised of alternating polarity magnets which effects tumbling of said carrier in said development zone, the toner particles having a mean volume weighted diameter of between 2 and 9 $\mu$m, preferably between 2 and 6 $\mu$m. In addition the developer can also be comprised of submicrometer (average size less than one micrometer) diameter so called "third component" particulate addenda such as silica, latex, strontium titanate, etc., commonly used to stabilize the toner charge, improve transfer, and assist flow, e) a transfer means, and f) a fusing means.

The apparatus of the invention involves the use of a plasma-polymerized fluorocarbon protective layer on a photoconductive element containing an electrically conductive base, two or more charge generation layers, and at least one charge transport layer. In contrast to prior art, the apparatus of this invention employs exposure in the blue region in combination with a photoconductive element that has long process lifetimes and good sensitivity to blue exposure. The electrophotographic properties of the photoconductive elements used in the apparatus of this invention are characterized by good photosensitivity, low residual voltage, and no latent image spread (LIS) over a range of ambient humidity conditions.

DETAILED DESCRIPTION OF THE INVENTION

The apparatus of this invention comprises a charging means, an exposure means that includes light of a wavelength between 350 and 500 nm, and a photoconductive element comprising at least one charge transport layer, two or more charge generation layers, and a plasma-polymerized fluorocarbon protective layer. This element has improved blue sensitivity. The apparatus can be used as an electrophotographic apparatus, such as a copier or printer.

A protective layer formed by a plasma-assisted deposition method and containing fluorine and carbon is known as a plasma-polymerized fluorocarbon layer. It is also sometimes referred to as a fluorinated amorphous carbon or a fluorinated diamond-like carbon layer. A diamond-like carbon (DLC) protective layer is also known as an amorphous carbon layer or a plasma-polymerized amorphous carbon layer. The protective layer of this invention is preferably formed by plasma-enhanced chemical vapor deposition (PE-CVD), also known as glow-discharge decomposition, using an alternating current (AC) or direct current (DC) power source. The AC supply preferably operates in the radio or microwave frequency range. More than one frequency can be used during deposition of the protective layer, for example through the combination of microwave and radio frequency power sources, in order to control the properties of the protective layer, as is known to one skilled in the art. Combination of a radio frequency or microwave sources with a direct current source is also known in the art. Selection of PE-CVD processing parameters, such as power source type or frequency, system pressure, feed gas flow rates, inert diluent gas addition, substrate temperature, and reactor configuration, to optimize product properties is well known in the art. The protective layer may comprise a single layer having a uniform composition or one or more multiple layers of non-uniform compositions; however, it is preferred that the protective layer is a single layer having a uniform composition. Further, the protective layer can be formed by a single or multiple passes through, for example, the PE-CVD apparatus or reactor; however, it is preferred that the protective layer is formed by a single pass through the PE-CVD apparatus or reactor. PE-CVD reactors are commercially available from, for example, PlasmaTherm, Inc.

The fluorine content of the protective layer can be equal to or greater than 2.2 and less than about 65 atomic percent, preferably between 10 and 65 atomic percent, more preferably between 25 and 50 atomic percent. Layers formed using plasma-assisted methods tend to be highly crosslinked films that do not exhibit long range order or a characteristic repeat unit like conventional polymers.

As noted, the atomic percent of fluorine in the protective layer can greater than 5 and less than about 65 atomic percent. The atomic percent of fluorine in the protective layer can be determined using X-Ray Photoelectron Spectroscopy (XPS). This is a well known technique for analyzing the composition of thin films. A typical measurement is described in detail in Example 1.

Feed gases that are preferred to be used to prepare the plasma-polymerized coatings, that is, the protective layer, used in this invention include sources of carbon and fluorine.

Sources of carbon include hydrocarbon and fluorocarbon compounds. The preferred hydrocarbon compounds include paraffinic hydrocarbons represented by the formula $C_nH_{2n+2}$, where n is 1 to 10, preferably 1 to 4; olefinic hydrocarbons represented by formula $C_nH_{2n}$, where n is 2 to 10, preferably from 2 to 4; acetylenic hydrocarbons represented by $C_nH_{2n-2}$, where n is 2 to 10, preferably 2; alicyclic hydrocarbons; and aromatic compounds; with up to 12 carbon atoms. This list includes, but is not limited to, the following: methane, ethane, propane, butane, pentane, hexane, heptane, octane, isobutane, isopentane, neopentane, isohexane, neohexane, dimethylbutane, methylhexane, ethylpentane, dimethylpentane, tributane, methylheptane, dimethylhexane, trimethylpentane, isononane and the like; ethylene, propylene, isobutylene, butene, pentene, methylbutene, heptene, tetramethylethylene, hexene, octene, allene, methyl-allene, butadiene, pentadiene, hexadiene, cyclopentadiene, ocimene, alloocimene, myrcene, hexatriene, acetylene, allylene, diacetylene, methylacetylene, butyne, pentyne, hexyne, heptyne, octyne, and the like; cyclopropane, cyclobutane, cyclopentane, cyclohexane, cycloheptane, cyclooctane, cyclopropene, cyclobutene, cyclopentene, cyclohexene, cycloheptene, cyclooctene, limonene, terpinolene, phellandrene, sylvestrene, thujene, carene, pinene, bornylene, camphene, tricyclene, bisabolene, zingiberene, curcumene, humalene, cadinenesesquibenihene, selinene, caryophyllene, santalene, cedrene, camphorene, phyllocladene, podocarprene, mirene, and the like; benzene, toluene, xylene, hemimellitene, pseudocumene, mesitylene, prehnitene, isodurene, durene, pentamethyl-benzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene, and the like. The hydrocarbon compounds need not always be in their gas phase at room temperature and atmospheric pressure, but can be in a liquid or solid phase insofar as they can be vaporized on melting, evaporation, or sublimation, for example, by heating or in a vacuum, in order to yield a gas phase of the hydrocarbon compound.

The preferred feed gases used to prepare plasma-polymerized fluorocarbon protective layers include sources of fluorine and carbon. Sources of fluorine include fluorocarbon compounds. Fluorocarbon compounds include but are not limited to paraffinic fluorocarbons represented by the formula $C_nF_xH_y$, where n is 1 to 10, preferably 2 to 4, x+y=2n+2, and x is 3 to 2n+2, preferably 2n+2; olefinic fluorocarbons represented by the formula $C_nF_xH_y$, where n is 2 to 10, preferably 2 to 4, x+y=2n, and x is 2 to 2n, preferably 2n; acetylenic fluorocarbons represented by $C_nF_xH_y$, where n is 2 to 10 preferably 2, x+y=2n-2, and x is 1 to 2n−2, preferably 2n−2; alkyl metal fluorides; aryl fluorides having from 6 to 14 carbon atoms; alicyclic fluorides, preferably perfluorinated alicyclic compounds, having from 3 to 8 carbon atoms, preferably from 3 to 6 carbon atoms; styrene fluorides; fluorine-substituted silanes; fluorinated ketones; and fluorinated aldehydes. These fluorocarbon feed compounds may have a branched structure. Examples include hexafluoroethane; tetrafluoroethylene; tetrafluoroethane; pentafluoroethane; octafluoropropane; 2H-heptafluoropropane; 1H-heptafluoropropane; hexafluoropropylene; 1,1,1,3,3,3-hexafluoropropane; 1,1,1,2,2,3-hexafluoropropane; 1,1,1,2,3,3-hexafluoropropane; 2-(trifluoromethyl)-1,1,1,3,3,3-hexafluoropropane; 3,3,3-trifluoropropyne; 1,1,1,3,3-pentafluoropropane; 1,1,1,3,3-pentafluoropropene; 1,1,1,2,2-pentafluoropropane; 3,3,3-trifluoropropyne; decafluorobutane; octafluorobutene; hexafluoro-2-butyne; 1,1,1,4,4,4-hexafluorobutane; 1,1,1,4,4,4-hexafluoro-2-butene; perfluoro(t-butyl)acetylene; dodecafluoropentane; decafluoropentene; 3,3,4,4,4-pentafluorobutene-1; perfluoroheptane; perfluoroheptene; perfluorohexane; 1H,1H,2H-perfluorohexene; perfluoro-2,3,5-trimethyl-hexene-2; perfluoro-2,3,5-trimethylhexene-3; perfluoro-2,4,5-trimethylhexene-2; 3,3,4,4,5,5,5-heptafluoro-1-pentene; decafluoropentene; perfluoro-2-methylpentane; perfluoro-2-methyl-2-pentene, perfluoro-4-methyl-2-pentene, hexafluoroacetone, perfluorobenzene, perfluorotoluene, perfluorostyrene, hexafluorosilane, dimethylaluminum fluoride, trimethyltin fluoride, and diethyltin difluoride. The fluorocarbon compounds need not always be in their gas phase at room temperature and atmospheric pressure, but can be in a liquid or solid phase insofar as they can be vaporized on melting, evaporation, or sublimation, for example, by heating or in a vacuum, in order to yield the fluorocarbon compound in its gas phase.

The plasma-polymerized fluorocarbon protective layers are prepared from sources of fluorine and carbon; thus, the protective layers can be prepared from fluorocarbon compounds alone. However, they can also be prepared from mixtures of fluorocarbons with other gases, for example hydrocarbon compounds, hydrogen, or inert gases. Paraffinic, fully fluorinated fluorocarbons and mixtures thereof are preferred. Olefinic or acetylinic hydrocarbons or mixtures thereof are preferred. Hydrogen is usually incorporated into the films in the form of the hydrogen present in the hydrocarbon feed gas. Pure hydrogen may also be used as an additional feed gas. Mixtures of two or more types of fluorocarbons can be used. Mixtures of two or more types of hydrocarbons can be used with one or more fluorocarbon compounds. Mixtures of one or more fluorocarbons, one or more hydrocarbons, and hydrogen can be used.

The presence of hydrogen is not required but may be included without loss of desirable properties. Oxygen may also be incorporated into the films from the feed gas or from atmospheric oxygen gained through reaction with reactive species present in the coating as it is removed from the reactor.

Inert gases such as argon, helium, neon, xeon, or the like optionally may be fed into the reactor during the deposition of the protective layers in order to control the properties of the coating. The use of inert gases to control coating properties is well known to those skilled in the art.

The thickness of the protective layer is preferably between about 0.05 and 0.5 micrometers, more preferably between about 0.15 and 0.35 micrometers.

Each charge transport layer of the photoconductive element contains, as the active charge transport material, one or more materials, preferably organic materials, capable of accepting and transporting charge carriers generated in the charge generation layer. Useful charge transport materials can generally be divided into two classes. That is, most charge transport materials generally will preferentially accept and transport either positive charges, holes, or negative charges, electrons, generated in the charge generation layers. Examples of charge-transport materials that transport holes are arylamines. Examples of arylamines that can be used in the charge transport layer of the photoconductive elements or methods of this invention include triphenylamine; tri-p-tolylamine; N-N'diphenyl-N,N'-bis(3-methylphenyl)-(1,1'-biphenyl)-4,4'diamine; 1,1-bis(di-4-tolylamino-phenyl)cyclohexane; N,N',N",N"-tetrakis(4-methylphenyl)-(1,1'-biphenyl)-4,4'-diamine; 4-(4-methoxystyryl)-4',4"-dimethoxytriphenylamine; N,N'-diphenyl-N,N'-di(m-tolyl)-p-benzidine; and mixtures of two or more of these charge transport materials. These and other useful arylamines are disclosed in U.S. Pat. No. 5,332,635 to Tanaka, U.S. Pat. No. 5,324,605 to Ono et al; and U.S. Pat. No. 5,202,207 to Kanemaru et al, incorporated herein by reference. The preferred arylamines are tri-p-tolylamine, 1,1-bis(di-4-tolylaminophenyl)cyclohexane, and mixtures of these two materials. Other useful hole transport materials include arylalkanes, hydrazones, and pyrazo-lines.

Examples of electron transport materials include diphenoquinones, charge-transfer complexes of poly(N-vinylcarbazole):2,4,7-trinitro-9-fluorenone, and 2,4,7-trinitro-9-fluorenone.

The CTL may comprise one or more binder materials and more than one charge transport materials. Any additional charge transport material (i.e. in excess of one) can be the same or different material from the first charge transport material. Common binder polymers include polystyrenes, polycarbonates, and polyesters. Useful polyester binders are described in commonly assigned, co-pending application U.S. Ser. No. 08/584,502, now U.S. Pat. No. 5,786,119, titled ELECTROPHOTOGRAPHIC ELEMENTS HAVING CHARGE TRANSPORT LAYERS CONTAINING HIGH MOBILITY POLYESTER BINDERS. The polyester binders have the following structural formula:

I

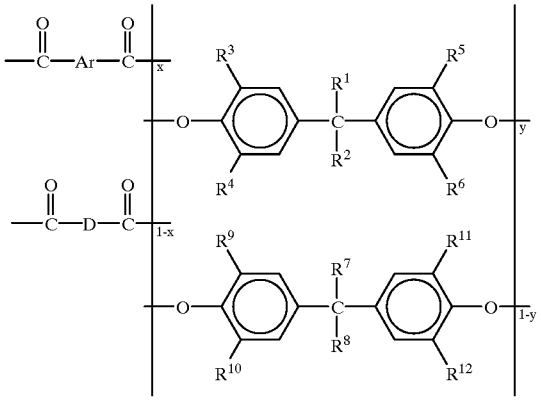

wherein:

Ar represents phenylene, terephthaloyl, isophthaloyl, 5-t-butyl-1,3-phenylene or phenylene indane;

D represents alkylene, linear or branched, or cycloalkylene, having from 4 to about 12 carbons;

$R^1$, $R^2$, $R^7$, and $R^8$ represent H, alkyl having 1 to 4 carbon atoms, cyclohexyl, norbornyl, phenylindanyl, perfluoralkyl having 1 to 4 carbon atoms, α, α-dihydrofluoroalkyl having 1 to 4 carbon atoms, or α, α, ω-hydrofluoroalkyl having 1 to 4 carbon atoms; and $R^3$, $R^4$, $R^5$, $R^6$, $R^9$, $R^{10}$, $R^{11}$, and $R^{12}$ represent H, halogen, or alkyl having from 1 to about 6 carbons; x is from 0 to 0.8; and y is from 0 to 1, with x and y being mole ratios.

The polyester binders can be prepared using well known solution polymerization techniques such as disclosed in W. Sorenson and T. Campbell, *Preparative Methods of Polymer Chemistry*, page 137, Interscience (1968). Schotten-Baumann conditions were employed to prepare the following examples of useful polyester binders: poly{4,4'-isopropylidene bisphenylene terephthalate-co-azelate (70/30)}; poly {4,4'-isopropylidene bisphenylene terephthalate-co-isophthalate-co-azelate (50/25/25)}; poly {4,4'-isopropylidene bisphenylene-co-4,4'-hexafluoroisopropylidene bisphenylene (75/25) terephthalate-co-azelate (65/35)}; poly-{4,4'-isopropylidene bisphenylene-co-4,4'-hexafluroisopropylidene bisphenylene (50/50) terephthalate-co-azelate (65/35)}; poly{4,4'-hexafluoroisopropylidene bisphenylene terephthalate-co-azelate (65/35)}; poly{hexafluoroisopropylidene bisphenylene terephthalate-co-isophthalate-co-azelate (50/25/25)}; and poly{4,4'isopropylidene bisphenylene isophthalate-co-azelate (50/50)}.

The thickness of the charge transport layer may vary. A preferred thickness for the charge transport layer is from about 2 to about 50 μm dry thickness. A more preferred range is from about 5 to about 30 μm.

Two or more charge generation layers (CGLs) are present in the photoconductive elements of this invention. Each charge generation layer comprises a charge generation material. The charge generation material can comprise one or more dye polymer aggregates, phthalocyanines, squaraines, perylenes, azo-compounds and trigonal selenium particles. The CGLs may comprise a binder; however, certain charge generation materials without a binder may be vacuum deposited to form a CGL. Examples of charge generation materials, useful binders and methods of preparing the CGL are disclosed in U.S. Pat. No. 4,886,722 to Law et al, U.S. Pat. No. 4,895,782 to Koyama et al, U.S. Pat. No. 5,330,865 to Leus et al, and U.S. Pat. No. 5,614,342 to Molaire et al, incorporated herein by reference. Additional charge generation materials and various sensitizing materials, such as spectral sensitizing dyes and chemical sensitizers may also be incorporated in each charge generation layer.

The charge generation materials in each of the CGLs can be the same or different and can be chosen to be or can be combined with appropriate sensitizers in order to be sensitive to the same or different wavelengths of radiation. A charge transport material can also be included in one or more of the charge generation layers. Examples of charge transport materials that are useful in charge generation layers include arylamines, particularly triarylamines, and polyarylalkanes, in particular 1,1-bis(di-4-tolylaminophenyl)-cyclohexane, and 4-N,N-(diethylamino) tetraphenylmethane. Different charge transport materials can be included in each of the charge generation layers of the photoconductive elements of this invention. For example, a triarylamine charge-transport material can be included in a first CGL and a polyarylalkane charge-transport material in a second CGL. Other pairs or sets of different materials could also be selected. Charge transport materials in the CTL can be the same as or different from any of the charge-transport materials in CGLs.

Each CGL preferably comprises dye polymer aggregate charge generation material dispersed in an insulating polymeric binder. Examples of useful dye polymer aggregates for use in the charge generation layer are disclosed in U.S. Pat. Nos. 4,175,960 and 3,615,414, incorporated herein by reference.

Useful binders in a CGL are known to a person of ordinary skill in the art. The preferred binders are polycarbonates, for example Lexan™ available from General Electric and Makrolon™ available from Mobay, Inc.

Charge generation layers and charge transport layers in elements of the invention can optionally contain other addenda such as leveling agents, surfactants, plasticizers, sensitizers, contrast control agents, and release agents, as is well known in the art.

A useful thickness for each charge generation layer is within the range of from about 0.1 to about 15 microns dry thickness, particularly from about 0.2 to about 10 microns.

The charge generation and charge transport layers in the photoconductive elements of this invention are affixed to an electrically conducting material or to an electrically insulating material coated with a conductive material. In any case, they are affixed to a substrate. A "substrate" can be either flexible or rigid for use in, for example, either web or drum format. A flexible substrate can be either electrically insulating or conducting. Suitable materials include polymers such as poly(ethylene terephthalate), nylon, polycarbonate, poly(vinyl butyral), poly(ethylene), etc., as well as aluminum, stainless steel, ceramics, ceramers, etc. If the substrate material is electrically insulating, it should be coated by a suitable process such as evaporation, sputtering, painting, solvent coating, etc., with a conductive layer such as nickel, copper, gold, aluminum, chromium, or suitable conducting polymers. An electrically conductive substrate material alone or the combination of an insulating substrate and an electrically conductive layer shall be referred to herein as an "electrically conductive base".

Either a charge generation layer or the charge transport layer may be in contact with the protective layer. In some cases, it may be desirable to use one or more intermediate subbing layers or additional charge transport layers between the conductive base and the CTL or a CGL, or between the CTL and a CGL to improve adhesion between the CTL, each of the CGLs and the conductive base and/or to act as an electrical barrier layer between the element and the conductive base.

Electrically conductive bases include, for example, paper (equilibrated to a relative humidity above 50 percent); aluminum-paper laminates; metal foils such as aluminum foil, zinc foil, etc.; metal plates, such as aluminum, copper, zinc, brass and galvanized plates; vapor deposited metal layers such as silver, chromium, nickel, aluminum and the like coated on paper or conventional photographic film supports, such as cellulose acetate, polystyrene, poly (ethylene terephthalate), etc. Such conductive materials as chromium, aluminum, or nickel can be vacuum deposited on transparent film supports in sufficiently thin layers to allow photoconductive elements prepared therewith to be exposed from either side of such elements.

In one method of preparation of the photoconductive elements used in the invention, the components of the charge generation layers, or the components of the charge transport layer, including binder and any desired addenda, are dissolved or dispersed together in an organic solvent to form a coating composition which is then solvent coated over an appropriate conductive support. The liquid is then allowed or caused to evaporate from the mixture to form the charge generation or charge transport layers.

Suitable organic solvents include aromatic hydrocarbons such as benzene, toluene, xylene and mesitylene; ketones such as acetone, butanone and 4-methyl-2-pentanone; halogenated hydrocarbons such as dichloromethane, 1,1,2-trichloroethane, chloroform and ethylene chloride; ethers including ethyl ether and cyclic ethers such as dioxane and tetrahydrofuran; other solvents such as acetonitrile and dimethylsulfoxide; and mixtures of such solvents. The amount of solvent used in forming the binder solution is typically in the range of from about 2 to about 100 parts of solvent per part of binder by weight, and preferably in the range of from about 10 to 50 parts of solvent per part of binder by weight.

In the preferred coating compositions, the optimum ratios of both charge generation material and charge transport material to binder can vary widely, depending on the particular materials employed. In general, useful results are obtained when the total concentration of both charge generation material and charge transport material in the layers is within the range of from about 0.01 to about 90 weight percent based on the dry weight of the layers. In a preferred embodiment of a multilayer photoconductive element of the invention, the coating composition contains from about 0 to about 40 weight percent of charge transport material and from 0.01 to about 80 weight percent of charge generation material based on the weight of the layer.

Another method for deposition of the CTL and CGLs is vacuum evaporation. It is possible to deposit only one of the layers by vacuum evaporation and the rest by coating from a solution or to deposit some fraction of the layers by vacuum evaporation and the rest by coating from a solution. Plasma-deposited charge transport layers are also possible.

The initial image forming step in electrophotography is the creation of an electrostatic latent image on the surface of a photoconductive element. This can be accomplished by charging the element in the dark to a positive or negative potential of several hundreds volts using a charging device, such as a corona or roller charging device, then exposing the photoconductive element in an image-wise fashion to form an image-wise pattern. Absorption of the image exposure creates free electron-hole pairs. Under the influence of the electric field depending upon the configuration of the CTL and CGLs, the holes migrate toward the conductive support, and the electrons migrate toward the surface of the photoconductive element, or the electrons migrate toward the conductive support and the holes migrate toward the surface of the photoconductive element. In such a manner, the surface charge is dissipated in the exposed regions, thus creating an electrostatic charge pattern. Electrophotographic toner can then be deposited onto the electrostatic charge pattern in the development step.

Development of the electrostatic latent image can be accomplished by passing the latent image bearing photoconductive element over a development station containing a dry powder developer. There are several different types of known development stations; however, the most commonly used station is a so-called magnetic brush station. Although so-called "single component developers" can be used in the development station, most often the developer is comprised of at least two components: magnetic carrier particles and smaller marking toner particles. The carrier particles, such as ferrite particles, are attracted to the magnetic brush in the development station and are used to transport the toner particles to the photoconductor. Moreover, the carrier particles are also comprised of a charge agent which induces a tribocharge on the toner particles. This tribo-electrically induced charge on the toner particles causes the particles to become attached to and develop the electrostatic latent image so that a visible image is produced. In addition there can be so called submicrometer diameter "third component" particulate addenda such as silica, latex, strontium titanate, etc., as are commonly used to assist transfer and flow and to stabilize the toner charge, present in the developer.

One development station that is particularly useful for producing high quality images is the small particle dry (SPD) development station, as described by Fritz et al. in U.S. Pat. No. 4,602,863, the contents of which are incorporated herein by reference. By rotating a magnetic core and using carrier particles having volume weighted diameters of about 30 μm, more uniform development of the electrostatic latent image could be obtained. It is preferred that the development station comprise an external shell, containing therein an internal core, the core comprised of between 8 and 24 magnets arranged in opposite polarity, with at least the core or the shell rotating so as to transport developer into the nip formed by the shell and the photoconductive element. Furthermore, when combined with small toner particles (i.e., those having volume weighted diameters of between 1 and 9 μm and preferably between 3 and 6 μm or less, as measured using commercially available devices such as a Coulter Multisizer, sold by Coulter, Inc.) images having very high quality can be produced. Volume weighted diameter is defined as the mass of each particle times the diameter of a spherical particle of equal mass and density, divided by the total particle mass. It is preferable to use toner particles with mean volume weighted diameters of between 1 and 9 μm, more preferably between 3 and 6 μm. It is more preferable that those toner particles are comprised of third component addenda, as discussed previously. It is more preferable that the magnetic core rotate between 300 and 3000 rpm and be comprised of alternating polarity magnets which effects tumbling of said carrier in said development zone, the toner particles having a mean volume weighted diameter of between 1 and 9 μm, preferably between 3 and 6 μm.

The resulting image can be transferred to a receiver such as uncoated or coated paper, plastic, or transparency material and rendered permanent with an appropriate fusing or fixing process.

The following examples are presented for a further understanding of the invention.

Photoconductive Element A

Photoconductive Element A was a multilayer inverse composite photoconductive element not having a DLC layer and was prepared as follows. First, a CTL solution was prepared by dissolving 57.5 wt % bisphenol-A-polycarbonate Makrolon™ 5705 (Mobay Chemical Company), 2.5 wt % of a copolymer containing 55% ethylene terephthalate and 45% neopentyl terephthalate, 20 wt % of 1,1-bis(di-4-tolylaminophenyl)-cyclohexane, and 20 wt % tri-4-tolylamine to 10 wt % solids in dichloromethane. DC510 phenyl-methyl-substituted siloxane surfactant (Dow Corning) was added at a concentration of 0.01 wt % of the total CTL solution. The CTL solution was coated onto a 7 mil thick nickelized poly(ethylene terephthalate) support to give a CTL layer with a dry thickness of 8.5 μm.

A first CGL solution, CGL-I solution, was prepared by dissolving 28.4 wt % bisphenol-A-polycarbonate Makrolon™ 5705 (Mobay Chemical Company), 28.4 wt % bisphenol-A-polycarbonate Lexan™ 145 (General Electric Company, New York), 1.6 wt % 4-(4-dimethylaminophenyl)-2,6-diphenylthiapyrylium hexafluorophosphate, 0.4 wt % 4-(4-dimethylaminophenyl)-2-(4-ethyloxyphenyl)-6-phenylthiapyrylium fluoroborate, and 39.2 wt % 1,1-bis(di-4-tolylaminophenyl)-cyclohexane, and 2 wt % "seed" into a 70/30 w/w dichloromethane/1,1,2-trichloroethane solvent mixture to give a 10% solids solution. DC510 surfactant was added at a concentration of 0.01 wt % of the total CGL-I solution. The "seed" consisted of 2.3 wt % 4-(4-dimethylaminophenyl)-2,6-diphenylthiapyrylium hexafluorophosphate, 1.5 wt % 4-(4-dimethylaminophenyl)-2-(4-ethyloxyphenyl)-6-phenylthiapyrylium fluoroborate, 67.3 wt % bisphenol-A-polycarbonate Makrolon™ 5705, and 28.9 wt % high molecular weight bisphenol-A-polycarbonate dissolved in a 70/30 w/w solvent mixture of dichloromethane and 1,1,2-trichloroethane. The CGL-I solution was coated on top of the CTL to give a CGL-I layer with a dry thickness of 10 μm.

A second CGL solution, CGL-II solution, was prepared by dissolving 51.2 wt % bisphenol-A-polycarbonate Makrolon™ 5705, 6.3 wt % 4-(4-dimethylaminophenyl)-2,6-diphenylthiapyrylium hexafluorophosphate, 1.6 wt % 4-(4-dimethylaminophenyl)-2-(4-ethyoxyphenyl)-6-phenylthiapyrylium fluoroborate, 39.0 wt % 4-N,N-(diethylamino)tetraphenylmethane, and 1.9 wt % g "seed" into a 70/30 w/w dichloromethane/1,1,2-trichloroethane solvent mixture to give a 10% solids solution. DC510 surfactant was added at a concentration of 0.01 wt % of the total CGL-II solution. CGL-II solution was coated atop the CGL-I layer to give a CGL-II layer with a dry thickness of 4 μm.

Comparative Example A

Blue exposure of a photoconductive element having a DLC protective layer containing no fluorine A commercial parallel-plate plasma reactor (PlasmaTherm Model 730) was used for deposition of the fluorinated DLC layer onto Photoconductive Element A. The deposition chamber consisted of two 0.28 meter outer diameter electrodes, a grounded upper electrode and a powered lower electrode. The chamber walls were grounded, and the chamber is 0.38 meter in diameter. Removal of heat from the electrodes was accomplished via a fluid jacket. Four outlet ports (0.04 $m^3$), arranged 90° apart on a 0.33 meter-diameter circle on the lower wall of the reactor, lead the gases to a blower backed by a mechanical pump. A capacitance manometer monitored the chamber pressure that was controlled by an exhaust valve and controller. A 600-W generator delivered radio-frequency (RF) power at 13.56 MHz through an automatic matching network to the reactor. The gases used in the deposition flowed radially outward from the perforated upper electrode in a showerhead configuration in the chamber. The Photoconductive Element A to which the DLC layer was to be applied was adhered to the lower electrode for deposition using double-stick tape. The element was coated at room temperature. The DLC layer was deposited on the CGL-II layer of Photoconductive Element A.

The DLC layer was deposited onto the photoconductor by introducing 116 sccm (standard cubic centimeters per minute) argon and 32 sccm acetylene into the reactor. The reactor pressure and RF power were 13.2 Pa and 100 W, respectively. Deposition time was 5 minutes.

Thickness of the DLC Layer

Simultaneous deposition of the coating layer on a silicon wafer allowed measurement of coating thickness using UV/VIS reflectometry. The thickness of the coating was measured to be 0.22 μm.

Composition of the DLC Layer

The composition of the DLC layer of Comparative Example A was analyzed using X-ray photoelectron spectroscopy (XPS). The XPS spectra were obtained on a Physical Electronics 5601 photoelectron spectrometer with monochromatic A1 Kα X-rays (1486.6 eV). All spectra were referenced to the C 1s peak for neutral (aliphatic) carbon atoms, which was assigned a value of 284.6 eV. Spectra were taken at a 45° electron takeoff angle (ETOA) which corresponds to an analysis depth of about 5 nm. Note that XPS is unable to detect hydrogen. The XPS results are presented in Table 1.

Blue Sensitivity Testing

Sensitometry testing was performed to measure the photosensitivity (also known simply as sensitivity) of the element to blue light exposure. This involved negatively charging the photoconductive element to 500 V in the dark, then exposing the photoconductive element to 400 nm radiation, and monitoring the change in voltage as a function of time. The exposure energy (erg/cm$^2$) is defined as the energy required to discharge the photoconductive element from 500 V to 250 V and is denoted as $E_{50\%}$; it is inversely related to the photosensitivity. Lower exposure energies are more desirable. The results are shown in Table 2.

Example 1

Blue exposure of a photoconductive element having a DLC protective layer containing approximately 6% fluorine The photoconductive element of this example was made according to the description in Comparative Example A except that a plasma-polymerized fluorocarbon layer was deposited with the following gas types and flow rates. Inert argon gas was introduced at a flow rate of 96 sccm, and the reactive gases acetylene and hexafluoroethane were introduced into the reaction chamber at flow rates of 24 sccm and 8 sccm, respectively. Deposition time was 7 minutes and 35 seconds.

Thickness of the plasma-polymerized fluorocarbon layer was 0.29 μm, determined as described in Comparative Example A.

The composition determination and blue sensitivity testing for this example were performed as described in Comparative Example A. The results appear in Tables 1–2.

Example 2

Blue exposure of a photoconductive element having a DLC protective layer containing approximately 15% fluorine The photoconductive element of this example was made according to the description in Comparative Example A except that the protective layer was a plasma-polymerized fluorocarbon and was deposited with the following gas types and flow rates. Inert argon gas was introduced at a flow rate of 64 sccm, and the reactive gases acetylene and hexafluoroethane were introduced into the reaction chamber at flow rates of 16 sccm each. Deposition time was 6 minutes and 57 seconds.

Thickness of the plasma-polymerized fluorocarbon layer was 0.29 μm, determined as described in Comparative Example A.

The composition determination and blue sensitivity testing for this example were performed as described in Comparative Example A. The results appear in Tables 1–2.

Example 3

Blue exposure of a photoconductive element having a DLC protective layer containing approximately 28% fluorine The photoconductive element of this example was made according to the description in Comparative Example A except that the protective layer was a plasma-polymerized fluorocarbon and was deposited with the following gas types and flow rates. Inert argon gas was introduced at a flow rate of 32 sccm, and the reactive gases acetylene and hexafluoroethane were introduced into the reaction chamber at flow rates of 28 sccm and 24 sccm, respectively. Deposition time was 4 minutes and 33 seconds.

Thickness of the plasma-polymerized fluorocarbon layer was 0.22 μm, determined as described in Comparative Example A.

The composition determination and blue sensitivity testing for this example were performed as described in Comparative Example A. The results appear in Tables 1–2.

Example 4

Blue exposure of a photoconductive element having a DLC protective layer containing approximately 43% fluorine The photoconductive element of this example was made according to the description in Comparative Example A except that the protective layer was a plasma-polymerized fluorocarbon and was deposited with the following gas types and flow rates. Inert argon gas was introduced at a flow rate of 12.8 sccm, and the reactive gases acetylene and hexafluoroethane were introduced into the reaction chamber at flow rates of 3.2 sccm and 28.8 sccm, respectively. Deposition time was 5 minutes and 19 seconds.

Thickness of the plasma-polymerized fluorocarbon layer was 0.32 μm, determined as described in Comparative Example A.

The composition determination and blue sensitivity testing for this example were performed as described in Comparative Example A. The results appear in Tables 1–2.

Comparative Example B

Blue exposure of a photoconductive element having a DLC protective layer containing 0% fluorine and prepared from ethylene Photoconductive element A was coated with a DLC layer in the manner described in Comparative Example A, except that the reactive feed gas used was 32 sccm ethylene, 116 sccm argon was used as an inert feed gas; and the deposition time was 12 minutes and 25 seconds.

The thickness of the DLC layer was 0.22 μm, determined as described in Comparative Example A.

The composition determination and blue sensitivity testing for this example were performed as described in Comparative Example A. The results appear in Tables 1–2.

Example 5

Blue exposure of a photoconductive element having a DLC protective layer containing approximately 2% fluorine Photoconductive element A was coated with a plasma-polymerized fluorocarbon layer in the manner described in Comparative Example A, except that the reactive feed gases used were 24 sccm ethylene and 8 sccm hexafluoroethane; 96 sccm argon was used as an inert feed gas; and the deposition time was 8 minutes and 51 seconds.

The thickness of the plasma-polymerized fluorocarbon layer was 0.2 μm, determined as described in Comparative Example A.

The composition determination and blue sensitivity testing for this example were performed as described in Comparative Example A. The results appear in Tables 1–2.

Example 6

Blue exposure of a photoconductive element having a DLC protective layer containing approximately 5% fluorine Photoconductive element A was coated with a plasma-polymerized fluorocarbon layer in the manner described in Comparative Example A, except that the reactive feed gases used were 16 sccm ethylene and 16 sccm hexafluoroethane; 64 sccm argon was used as an inert feed gas; and the deposition time was 9 minutes and 27 seconds.

The thickness of the plasma-polymerized fluorocarbon layer was 0.2 $\mu$m, determined as described in Comparative Example A.

The composition determination and blue sensitivity testing for this example were performed as described in Comparative Example A. The results appear in Tables 1–2.

Example 7

Blue exposure of a photoconductive element having a DLC protective layer containing approximately 16% fluorine Photoconductive element A was coated with a plasma-polymerized fluorocarbon layer in the manner described in Comparative Example A, except that the reactive feed gases used were 8 sccm ethylene and 24 sccm hexafluoroethane; 32 sccm argon was used as an inert feed gas; and the deposition time was 10 minutes and 40 seconds.

The thickness of the plasma-polymerized fluorocarbon layer was 0.24 $\mu$m, determined as described in Comparative Example A.

The composition determination and blue sensitivity testing for this example were performed as described in Comparative Example A. The results appear in Tables 1–2.

Example 8

Blue exposure of a photoconductive element having a DLC protective layer containing approximately 40% fluorine Photoconductive element A was coated with a plasma-polymerized fluorocarbon layer in the manner described in Comparative Example A, except that the reactive feed gases used were 3.2 sccm ethylene and 28.8 sccm hexafluoroethane; 12.8 sccm argon was used as an inert feed gas; and the deposition time was 9 minutes and 56 seconds.

The thickness of the plasma-polymerized fluorocarbon layer was 0.24 $\mu$m, determined as described in Example 1.

The composition determination and blue sensitivity testing for this example were performed as described in Comparative Example A. The results appear in Tables 1–2.

An electrophotographic apparatus employing exposures in the blue region of the spectrum must contain a photoconductive element that has good sensitivity to blue exposures. This element must further fulfill the basic requirements of a photoconductive element used in any electrophotographic apparatus, namely, (1) good electrophotographic properties such as low $E_{50\%}$, residual voltage, and lateral image spread, (2) no delamination failure, as measured by poor adhesion between the protective coating and the photoconductive layers; and (3) ability to withstand bending over small bending radii. A photoconductive element having an electrically conductive base, two or more charge generation layers, at least one charge transport layer, and a protective layer comprising plasma-polymerized fluorocarbon, wherein the fluorine content of said protective layer is greater than 5 and less than about 65 atomic percent and wherein the thickness of said protective layer is preferably between 0.05 and 0.5 $\mu$m, satisfies these requirements.

The improvement in the blue sensitivity of the photoconductive elements used in the apparatus of this invention compared to prior art is shown in the data of Tables 1 and 2. Whereas the photoconductive elements having diamond-like carbon protective layers (Comparative Examples A and B) have $E_{50\%}$ in excess of 7.2 erg/cm$^2$ when exposure is in the blue region of the spectrum, indicating unacceptably low photosensitivity in the blue range, the photoconductive elements of this invention having plasma-polymerized fluorocarbon protective layers have $E_{50\%}$ values of less than 6.5 erg/cm$^2$ at 400 nm radiation, indicating a significant improvement in blue sensitivity. The improvement in blue sensitivity improves still further as the fluorine concentration in the protective layer is increased to 10 atomic percent, and still more improvement is observed when the fluorine concentration is increased to 25 atomic percent and above.

The acceptable electrophotographic properties of the elements used in the apparatus of this invention were demonstrated by sensitometry testing and testing for latent image spread, also known as fogging or image drift. The elements displayed good electrophotographic properties and did not undergo latent image spread.

The excellent adhesion of the plasma-polymerized fluorocarbon protective layer to the photoconductive layers in the elements of this invention was demonstrated through the adhesion testing of the elements in all the Examples. Each element passed the adhesion test. Unlike the prior art, no problems associated with adhesion of the protective layer with the photoconductive layers were observed.

The excellent adhesion and thinness of the protective layers of the elements of this invention ensure that these elements are capable of withstanding bending around objects of small bending radius.

Thus, it is shown that the apparatus of this invention, containing the specified photoconductive elements, satisfy all the necessary conditions for usefulness in an electrophotographic apparatus and additionally offer improved blue sensitivity and therefore improved performance compared to the prior art.

TABLE 1

Compositions of the Protective Layers of Comparative Examples A and B and Examples 1–4

| Example or Comparative Example | Composition C(%) | F(%) | O(%) |
|---|---|---|---|
| Comp. Ex. A | 88.3 | 0 | 10.2 |
| Ex. 1 | 80.8 | 5.7 | 11 |
| Ex. 2 | 75.2 | 14.5 | 9.1 |
| Ex. 3 | 63.6 | 28.3 | 6.8 |
| Ex. 4 | 52.4 | 42.6 | 4.2 |
| Comp. Ex. B | 91.1 | 0 | 7.5 |
| Ex. 5 | 86.3 | 2.2 | 9.0 |
| Ex. 6 | 83.6 | 5.2 | 9.1 |

TABLE 1-continued

Compositions of the Protective Layers of Comparative Examples A and B and Examples 1–4

| Example or Comparative Example | Composition C(%) | F(%) | O(%) |
|---|---|---|---|
| Ex. 7 | 74.8 | 15.7 | 7.8 |
| Ex. 8 | 53.0 | 39.5 | 6.0 |

TABLE 2

Blue Sensitivity Testing Results for Examples 1–4 and Comparative Examples A and B

| Example or Comparative Example | $E_{50\%}$ (erg/cm$^2$) |
|---|---|
| Comp. Ex. A | 7.28 |
| Ex. 1 | 6.45 |
| Ex. 2 | 4.05 |
| Ex. 3 | 2.51 |
| Ex. 4 | 2.23 |
| Comparative Example B | 7.57 |
| Example 5 | 4.90 |
| Example 6 | 5.89 |
| Example 7 | 4.80 |
| Example 8 | 3.57 |

The invention has been described in detail with particular reference to certain preferred embodiments thereof, but it will be understood that variations and modifications can be effected within the spirit and scope of the invention.

What is claimed is:

1. A method of making an image in an electrophotographic apparatus comprising the steps of:

a) providing a charging means;

b) providing a photoconductive element comprising an electrically conductive base, two or more charge generation layers, at least one charge transport layer, and a protective layer comprising plasma-polymerized fluorocarbon, wherein the fluorine content is equal to or greater than 2.2 and less than 65 atomic percent and is uniformly distributed throughout said layer;

c) charging the element in step b) and then exposing it imagewise to an exposure means with light restricted to the wavelength range between 350 and 500 nanometers, thereby creating an electrostatic latent image on the surface of the photoconductive element.

2. The method of claim 1 further comprising the step of passing the electrostatic latent image through a development station to produce a visible image.

3. An electrophotographic apparatus comprising:

a) a charging means;

b) an exposure means including light in the wavelength range between 350 and 500 nanometers, and c) a photoconductive element comprising an electrically conductive base, two or more charge generation layers, at least one charge transport layer, and a protective layer comprising plasma-polymerized fluorocarbon, wherein the fluorine content of said protective layer is equal to or greater than 2.2 and less than 65 atomic percent and is uniformly distributed throughout said layer.

4. An electrophotographic apparatus according to claim 3 wherein the protective layer comprises between 10 and 65 atomic percent fluorine.

5. An electrophotographic apparatus according to claim 4 wherein the protective layer of the photoconductive element comprises between 25 and 50 atomic percent fluorine.

6. An electrophotographic apparatus according to claim 3 wherein the thickness of the protective layer of the photoconductive element is between 0.05 and 0.5 $\mu$m.

7. An electrophotographic apparatus according to claim 6 wherein the thickness of the protective layer of the photoconductive element is between 0.15 and 0.35 $\mu$m.

8. An electrophotographic apparatus according to claim 3 wherein the protective layer of the photoconductive element contains oxygen or hydrogen.

9. An electrophotographic apparatus according to claim 3 wherein one of the charge generation layers is adjacent to the protective layer.

10. An electrophotographic apparatus according to claim 3 wherein at least one of the charge transport layers is adjacent to the protective layer.

11. The electrophotographic apparatus of claim 4 further comprising a development station including electrophotographic developer.

12. The apparatus of claim 11 further comprising a) a transfer means; and b) a fusing means.

13. The apparatus of claim 11 wherein the developer comprises hard magnetic carrier particles and electrically insulative toner particles in contacting developing relation with the electrostatic charger pattern in the development zone.

14. The electrophotographic apparatus of claim 11 wherein the development station comprises an external shell, containing therein a core, the core comprised of between 8 and 24 magnets arranged in opposite polarity, with at least the core or the shell rotating so as to transport developer into the nip formed by the shell and the photoconductive element.

15. The electrophotographic apparatus of claim 11 wherein the development station comprises:

a) an external shell, containing therein a core, the core comprised of between 8 and 24 magnets arranged in opposite polarity, wherein the core rotates between 300 and 3000 rpm, said core being comprised of alternating polarity magnets which effect tumbling of said carrier in said development zone, and b) a developer comprising hard magnetic carrier particles and electrically insulative toner particles in contacting developing relation with the electrostatic charger pattern in the development zone, said toner particles having a mean volume weighted diameter of between 2 and 9 $\mu$m.

16. An electrophotographic apparatus according to claim 3 wherein the photoconductive element comprises, in order:

a) an electrically conductive base;

b) a charge-transport layer;

c) a first charge-generation layer containing a charge-generation material and a first charge-transport material;

d) a second charge-generation layer containing a charge-generation material and a second charge-transport material; and e) a plasma-polymerized fluorocarbon protective layer, wherein the fluorine content of the protective layer is equal to or greater than 2.2 and less than 65 atomic percent and is uniformly distributed throughout said layer.

17. An electrophotographic apparatus according to claim 13 wherein each of the charge generation materials in the first and second charge generation layers comprises a dye polymer aggregate, the first charge-transport material comprises 1,1-bis(di-4-tolylaminophenyl)-cyclohexane and the second charge-transport material comprises 4-N,N-(diethylamino)tetraphenylmethane, and the charge transport layer comprises an arylamine selected from the group consisting of triphenylamine; tri-4-tolylamine; N-N'diphenyl-N,N'-bis(3-methylphenyl)-(1,1'-biphenyl)-4,4'diamine; 1,1-bis(di-4-tolylaminophenyl)cyclohexane; 4-(4-methoxystyryl)-4',4"-dimethoxytriphenylamine; N,N'-diphenyl-N,N'-di(m-tolyl)-p-benzidine; N,N',N",N"-tetrakis(4-methylphenyl)-(1,1'-biphenyl)-4,4'-diamine; and mixtures of these materials.

18. The electrophotographic apparatus of claim 16 wherein the fluorine content of said protective layer comprises between 10 and 65 atomic percent fluorine.

19. The electrophotographic apparatus of claim 18 wherein the fluorine content of said protective layer comprises between 25 and 50 atomic percent fluorine.

20. The electrophotographic apparatus of claim 19 wherein the fluorine content of said protective layer comprises between about 14 and about 43 atomic percent fluorine.

* * * * *